United States Patent [19]

Rosell

[11] 4,227,723

[45] Oct. 14, 1980

[54] MULTIPLE BOLT LATCH

[75] Inventor: Jean Rosell, Etalondes, France

[73] Assignee: Laperche, Friville Escarbotin, France

[21] Appl. No.: 941,679

[22] Filed: Sep. 12, 1978

[30] Foreign Application Priority Data

Sep. 16, 1977 [FR] France ..... 77 27978

[51] Int. Cl.[2] ..... E05C 1/16

[52] U.S. Cl. ..... 292/34; 292/40; 292/161

[58] Field of Search ..... 292/34, 37, 39, 40, 292/117, 118, 156, 157, 158, 159, 160, 161, 162; 70/118, 120, 131

[56] References Cited

U.S. PATENT DOCUMENTS

| | | | |
|---|---|---|---|
| 1,078,549 | 11/1913 | Northey | 292/161 |
| 1,590,441 | 6/1926 | Piggot | 292/161 |
| 1,642,501 | 9/1927 | Knell | 292/156 X |
| 2,406,459 | 8/1946 | Gibson | 292/39 |
| 3,722,236 | 3/1973 | Zelenko | 292/161 X |

FOREIGN PATENT DOCUMENTS

| | | | |
|---|---|---|---|
| 167951 | 1/1920 | Fed. Rep. of Germany | 292/156 |
| 1286934 | 9/1969 | Fed. Rep. of Germany | 292/34 |
| 2341263 | 3/1974 | Fed. Rep. of Germany | 292/40 |
| 709399 | 6/1966 | Italy | 292/34 |
| 726860 | 12/1966 | Italy | 292/160 |
| 23892 | 4/1902 | Switzerland | 292/160 |

*Primary Examiner*—Thomas J. Holko

*Attorney, Agent, or Firm*—Irons and Sears

[57] ABSTRACT

The latch comprises a case, containing a mechanism for actuating a half-turn bolt, and a head plate. At least one half-turn bolt is provided which is mounted to be movable in a direction parallel to the plane of the head plate of the latch.

7 Claims, 2 Drawing Figures

MULTIPLE BOLT LATCH

The present invention relates to latches and more particularly to a latch for closing and locking a door, a French window or the like at a plurality of points thereof.

Latches of this type are known which comprise a conventional spring bolt, which is locked by means of a cylinder device for example, and rollers disposed on each side of the half-turn bolt and controlled to be engaged in corresponding keepers provided in the door frame, for example by imparting to the lever handle or knob of the latch a movement in the direction opposed to the normal opening movement relative to the position of equilibrium of said lever handle.

The main drawback of latches of this type which are of the cremorne bolt family, resides in the fact that the engagement of the three closing elements of the latch in their respective keepers requires two separate movements, namely a thrust exerted on the door and a closure of the bolts by shifting the lever handle upwardly.

It is known that in the building industry, the door-frame elements are usually mounted immediately after the end of the construction of the main walls, that is to say a long time before the building or dwelling is finished.

Consequently, it is the practice to place doors in position whose door proper or door leaf, if constructed from relatively young wood, is liable to warp when it is not maintained applied against its respective door-frame.

Now, the very fact that in order to engage the rollers in their respective keepers, it is necessary to carry out an operation separate from the actuation of the spring bolt, involves risk that the user forgets to actuate the rollers which results in an imperfect closure so that the imperfectly closed door warps and can no longer be correctly closed thereafter.

This constitutes a serious drawback of conventional latches of this type, independently of the drawback constituted by the door-closing operation in two stages in order to ensure the closure at three points.

An object of the invention is to overcome the aforementioned drawbacks by providing a latch of the type inserted in a mortise or applied against the edge of the door which permits ensuring the closure and latching at a plurality of points of a door proper or door-leaf on which it is mounted, while being actuated in the manner of a conventional latch by a thrust exerted on the door.

According to the invention, there is provided a latch of the aforementioned type comprising a case containing a mechanism for actuating a half-turn bolt and a head plate wherein there is provided at least one spring bolt which is mounted to be movable in a direction parallel to the plane of said head plate of said lock.

Further features of the invention will be apparent from the ensuing description.

Figure 1:
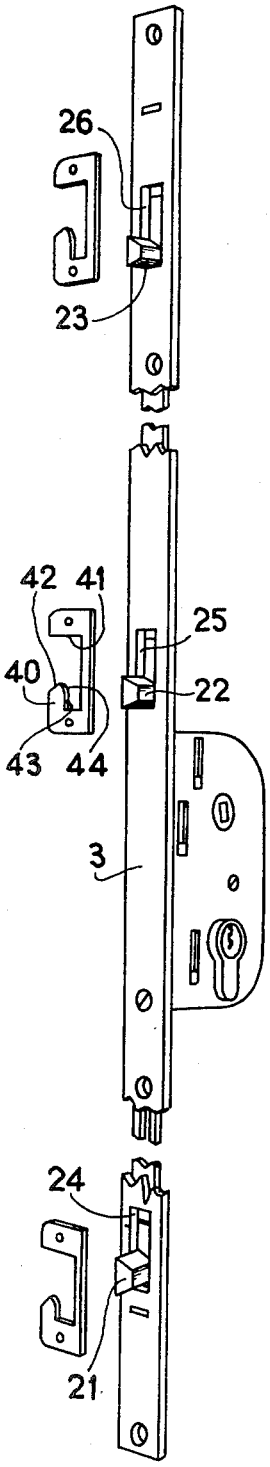
Figure 2:
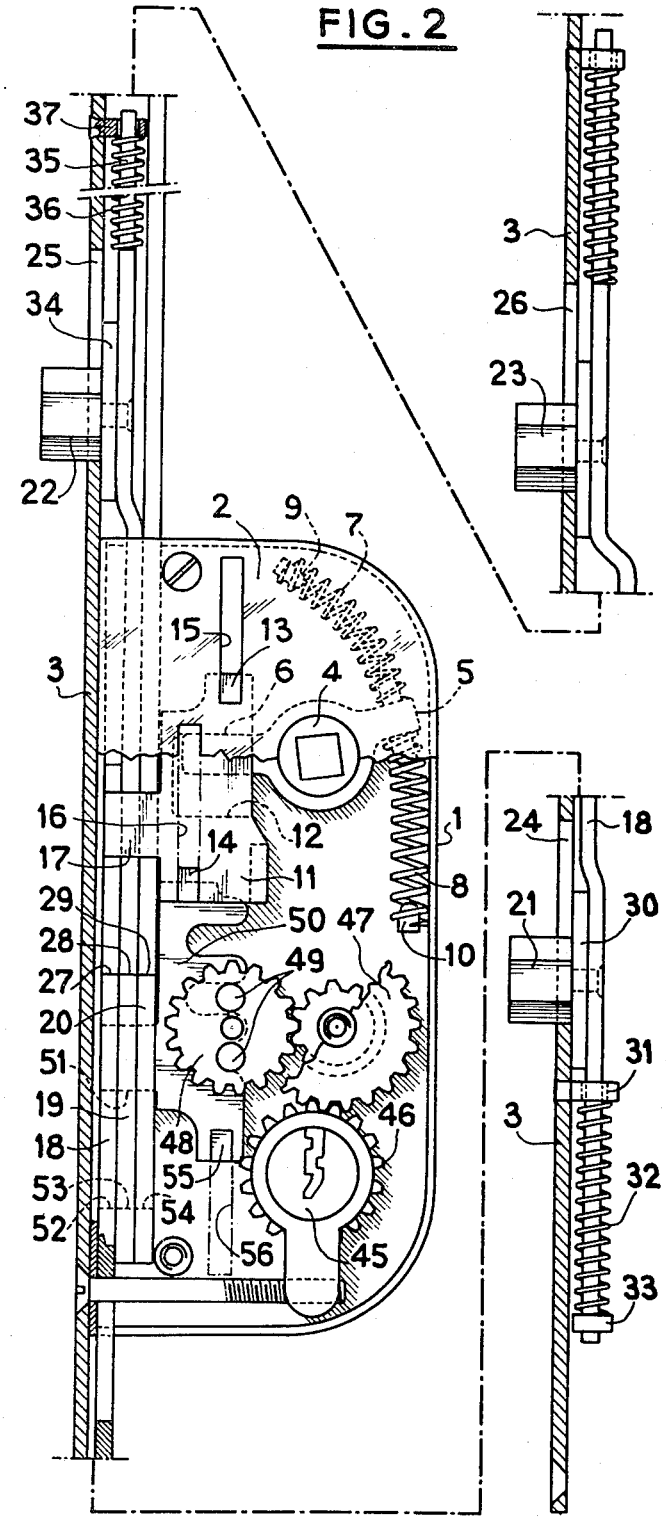

In the accompanying drawings which is given merely by way of example:

FIG. 1 is a perspective view of a latch according to the invention and keepers with which the spring bolts of said latch are cooperative, and FIG. 2 is a sectional view with a part cut away of the latch shown in FIG. 1.

The latch shown in the drawing comprises a case constituted by a latch-box 1 and a side plate 2 shown partly cut away, and a vertical head plate 3 of great length and adapted to be applied against the edge of the door proper or leaf of a door for example.

As can be seen in FIG. 2, the case of the latch contains a member 4 defining a door-knob hole and having two arms 5 and 6. The arm 5, which extends away from the plate 3, is maintained in an intermediate position by two opposing springs 7 and 8 both of which bear against respective abutments 9, 10 rigid with the latch-box 1. The arm 6 of the member 4 is adapted to actuate a slide member 11 which has a recess 12 into which the arm 6 extends. The slide member 11 which is guided in the case of the latch by projections 13, 14 which are respectively engaged in slots 15, 16 formed in the latch-box 1 and the plate 2, comprises a heel portion 17 which is adapted to drive rods 18, 19 and 20 each comprising a spring bolt 21, 22 and 23 which is slidably mounted in a corresponding slot 24, 25, 26 formed in the plate 3.

The ends of the rods 18 to 20 within the case of the latch are superimposed and each provided with a notch 27, 28 and 29 whose length exceeds the length of the heel portion 17 which is engaged in the three notches.

The rods 18 to 20 are disposed behind the head plate 3 and parallel to the latter.

The bolt 21 is fixed to the rod 18 through a spacer plate 30 and the end of the rod 18 extending beyond the bolt 21 has a smaller section and extends through a guide 31 which constitutes an abutment for a return coil spring 32 which is mounted on this end part of small section and held stationary at its end opposed to the guide 31 by a stop member 33.

The bolt 22 is also mounted on the rod 19 through a spacer plate 34 and the end part of the rod 19 extending beyond the bolt 22 comprises a portion 35 of smaller section carrying a return coil spring 36 which bears against a guide 37 fixed to the plate 3 and through which guide the portion 35 of the rod 19 extends.

The assembly of the spring bolt 23 is similar to the assembly of the spring bolt 22 so that there is no need to describe it further.

The bolts 21, 22 and 23 have in a direction parallel to the plate 3 a trapezoidal section which is adapted to facilitate their engagement in the corresponding keepers such as the keeper 40 shown in FIG. 1. This keeper comprises mainly a plate adapted to be mounted on a door-frame or post (not shown) which is suitably recessed. The keeper 40 comprises a notch 41 whose width exceeds the width of the corresponding bolt 22 and has an oblique wall 42 in order to promote the retraction of the bolt when it is engaged in the keeper. The notch 41 also has a part 43 which retains the bolt and has a rounded portion 44 for facilitating the penetration of the bolt in the retaining part 43 of the keeper.

The latch according to the invention further comprises a locking device which includes, in the illustrated embodiment, a cylinder 45 actuated by a key and provided with a gear pinion 46 which drives, through a speed-reducing gear pinion 47 and a gear pinion 48 provided with two drive lugs or pins 49, a rack 50 which comprises a heel portion 51 engaged in a set of notches 52 to 54 formed in the rods 18 to 20 which carry the spring bolts.

The rack 50 is guided in its movements by projecting portions such as 55 which are engaged in slots such as 56 provided in the latch-box of the case of the latch.

If it is desired to simultaneously withdraw the three spring bolts, the member 4 is acted upon by means of a lever handle or a knob (not shown) in the clockwise direction in opposition to the action of the spring 8. In this way the arm 6 of the member 4 shifts the slide member 11 upwardly as viewed in FIG. 2, the heel portion 17 of the slide member which is engaged with the upper edges of the notches 27, 28, 29 of the rods 18, 19 and 20 shifting these rods upwardly, that is to say in opposition to the action of return springs such as 32 and 36 of the half-turn bolts. The spring bolts 21 to 23 are consequently simultaneously shifted upwardly as viewed in FIG. 2. If the bolts 21 to 23 are initially engaged in their respective keepers 40, the aforementioned upward movement shifts the bolts out of the retaining parts 43 of the keepers and thus releases the bolts.

On the other hand, if the latch is in the unlocked state and it is desired to close a door provided with said latch by the engagement of the bolts 21 to 23 in their corresponding keepers 40, it is possible either to proceed in the same manner as before by acting on the member 4 or to merely push the door closed. Thereupon, the spring bolts 21 to 23 come in contact by their oblique sides with the oblique edges 42 of the keepers 40 so that they are shifted back in opposition to the action of the return springs such as 32 and 36. Then, when the bolts have passed beyond the oblique edges 42 of their respective keepers, they engage in the retaining parts 43 of the keepers under the action of their respective return springs independently of each other.

Thus, it can be seen that, notwithstanding the fact the spring bolts of the latch according to the invention move in a direction parallel to the plane of the plate 3, the latch operates in a similar manner to an ordinary latch.

When it is desired to lock the spring bolts, the cylinder 45 is acted upon by means of a key (not shown) so that this cylinder drives the rack 50 downwardly as viewed in FIG. 2 through the pinions 47 and 48. The heel portion 51 of the rack then abuts the lower edges of the notches 52 to 54 of the rods 18 to 20 and thereby holds the rods in the position thereof corresponding to the engagement of the bolts 21 to 23 in the retaining parts 43 of their corresponding keepers 40. The latch is now locked.

To unlock the latch, the rack is shifted in the opposite direction.

The latch just described has the advantage over latches of the prior art of being actuatable in the manner of an ordinary latch. Moreover, the fact of sliding the bolts in a direction parallel to the plane of the plate 3 and not in a direction perpendicular to the latter, economizes space and enables a shallower mortise or recess to be made in the door if a mortise latch is employed.

In the embodiment shown in FIG. 2, the latch according to the invention comprises three spring bolts. However, it will be understood that such a latch may have a greater or smaller number of spring bolts depending on the dimensions of the door and the safety required.

After a latch according to the invention has been mounted, the door is perfectly applied against its doorframe and no longer has any tendency to move and become warped.

In order to still further reduce any danger of warping, the rounded portions 44 provided at the entrance of the retaining parts 43 for the bolts on the keepers 40 allow the spring bolts to penetrate these retaining parts even if there exists a certain lack of alignment either between the keepers or between the bolts when the door on which the latch is mounted is slightly distorted.

Moreover, the speed-reducing means 47 provided in the locking mechanism enables the spring bolts 21 to 23 to be fully introduced in the retaining parts with less effort so that there is less risk of breaking the key.

The latch just described is a mortise latch, but it will be understood that it can also be constructed in the form of a latch to be applied against the door.

Having now described my invention what I claim as new and desire to secure by Letters Patent is:

1. A latch comprising a case, a head plate, at least one spring bolt, means for mounting the bolt relative to said plate so that the bolt is movable in a direction parallel to the plane of said plate and a mechanism within the case for actuating the spring bolt, said bolt mounting means comprising a rod which carries the bolt and is disposed behind said plate and has a first end portion remote from the bolt, which first end portion is engaged with the actuating mechanism which comprises a member which defines means for receiving a latch-operating member and includes a first arm and a second arm, elastically yieldable means for maintaining the first arm in position, a slide member slidably mounted in the case and defining a slide member notch, the second arm being engaged in the notch of said slide member, said first end portion of said rod defining a first rod notch and the slide member having a heel portion engaged in the first notch of the first end portion of the rod.

2. A latch as claimed in claim 1, wherein abutment means are rigid with said plate, said rod comprises at a second end thereof carrying the bolt a second end portion and a return spring is mounted on said second end portion and bears against the abutment means.

3. A latch as claimed in claim 1 or 2, further comprising a locking mechanism for locking the bolt and comprising means for receiving a key, a rack mounted relative to the case to be movable in translation and including teeth, rotary means carrying lugs which are engageable with the teeth of the rack to move the rack in translation, the fod defining a second rod notch and the rack comprising a heel portion engaged in said second rod notch.

4. A latch as claimed in claim 1 or 2, comprising a plurality of said spring bolts, in said plate for slidably mounting the corresponding bolts and a plurality of said rods carrying the corresponding bolts, the rods having said first end portions inside the case which are superimposed and are in simultaneous engagement with the actuating mechanism.

5. A latch as claimed in claim 4, wherein said rods comprise in the superimposed first end portions thereof aligned first rod notches in which aligned notches the heel portion of the slide member is engaged.

6. A latch as claimed in claim 5, further comprising a locking mechanism for locking the bolts and comprising means for receiving a key, a rack mounted relative to the case to be movable in translation and including teeth, rotary means carrying lugs which are engageable with the teeth of the rack to move the rack in translation, said superimposed first end portions of the rods being engaged by the rack to be shifted by the rack.

7. A latch as claimed in claim 6, wherein said rods define aligned second rod notches in which the heel portion of the rack of the locking mechanism is engaged for shifting the rods.

* * * * *